US006508688B1

(12) United States Patent
Liu

(10) Patent No.: US 6,508,688 B1
(45) Date of Patent: Jan. 21, 2003

(54) REVOLVING STRUCTURE FOR BUILT-UP TOY

(76) Inventor: Kuo-Ching Liu, 5Fl., No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 10/190,476

(22) Filed: Jul. 9, 2002

(51) Int. Cl.[7] ..... A63H 3/16
(52) U.S. Cl. ..... 446/97; 446/359; 446/387
(58) Field of Search ..... 446/97, 98, 99, 446/101, 102, 103, 108, 111, 387, 330, 359, 367, 85

(56) References Cited

U.S. PATENT DOCUMENTS 3,193,293 A * 7/1965 Schaper ..... 273/153 R
6,419,542 B1 * 7/2000 Liu ..... 446/97
6,439,945 B1 * 8/2002 Liu ..... 446/97

* cited by examiner

*Primary Examiner*—Jacob K. Ackun
(74) *Attorney, Agent, or Firm*—Rosenberg, Klein & Lee

(57) ABSTRACT

A revolving structure for built-up toy mainly includes a flat base having round holes provided thereon, flat gear members separately located above the round holes to mesh with one another, disc-shaped stoppers separately located below the round holes, and flat rotating shafts vertically extended through the gear members, the round holes, and the stoppers to project a length from a bottom side of the base. A built-up toy is engaged with a top of each rotating shaft. By turning any one of the rotating shafts at the projected length below the base, the gear members are rotated to revolve all built-up toys connected to the rotating shafts. An interesting dynamic effect is therefore created for the otherwise stationary built-up toys.

7 Claims, 5 Drawing Sheets

REVOLVING STRUCTURE FOR BUILT-UP TOY

FIELD OF THE INVENTION

The present invention relates to a revolving structure, and more particularly to a revolving structure that is mounted on a flat base to enable multiple built-up toys connected thereto to revolve at the same time.

BACKGROUND OF THE INVENTION

Generally, a built-up toy includes a plurality of flat parts that are initially formed on a board structure by stamping and can be separated from the board structure one by one to assemble into a desired toy by engaging slits preformed thereon with one another.

Most currently commercially available built-up toys are designed to construct only stationary and monotonous animals, plants, articles, etc., such as dinosaurs, dolls, and furniture. These built-up toys provide only still models and are therefore less interesting and attractive for play.

It is therefore desirable to develop a revolving structure that is also formed from flat parts to rotate multiple built-up toys at the same time and therefore creates an interesting and dynamic effect for the otherwise stationary built-up toys.

SUMMARY OF THE INVENTION

A primary object of the present invention is to provide a revolving structure for built-up toy. The revolving structure mainly includes a flat base having round holes provided thereon, flat gear members separately located above the round holes to mesh with one another, disc-shaped stoppers separately located below the round holes, and flat rotating shafts vertically extended through the gear members, the round holes, and the stoppers to project a length from a bottom side of the base. A built-up toy is engaged with a top of each rotating shaft. By turning any one of the rotating shafts at the projected length below the base, the gear members are rotated to revolve all built-up toys connected to the rotating shafts. An interesting dynamic effect is therefore created for the otherwise stationary built-up toys.

Another object of the present invention is to provide a revolving structure for built-up toy, wherein the revolving structure is formed from a plurality of flat parts.

A further object of the present invention is to provide a revolving structure for built-up toy, wherein the revolving structure is formed from a plurality of flat parts that are initially detachably connected to a flat board to be conveniently packed or transported along with other products.

A still further object of the present invention is to provide a revolving structure for built-up toy, wherein the revolving structure is provided at a top of each rotating shaft thereof with a slit for engaging with another slit provided at a bottom of any built-up toy, so as to connect the built-up toy to the revolving structure. The built-up toy may be a model consisting of multiple flat parts connected to one another in a predetermined manner or simply a flat part having a specific shape. In either case, the revolving structure is designed for multiple built-up toys to revolve at the same time without interfering with one another.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
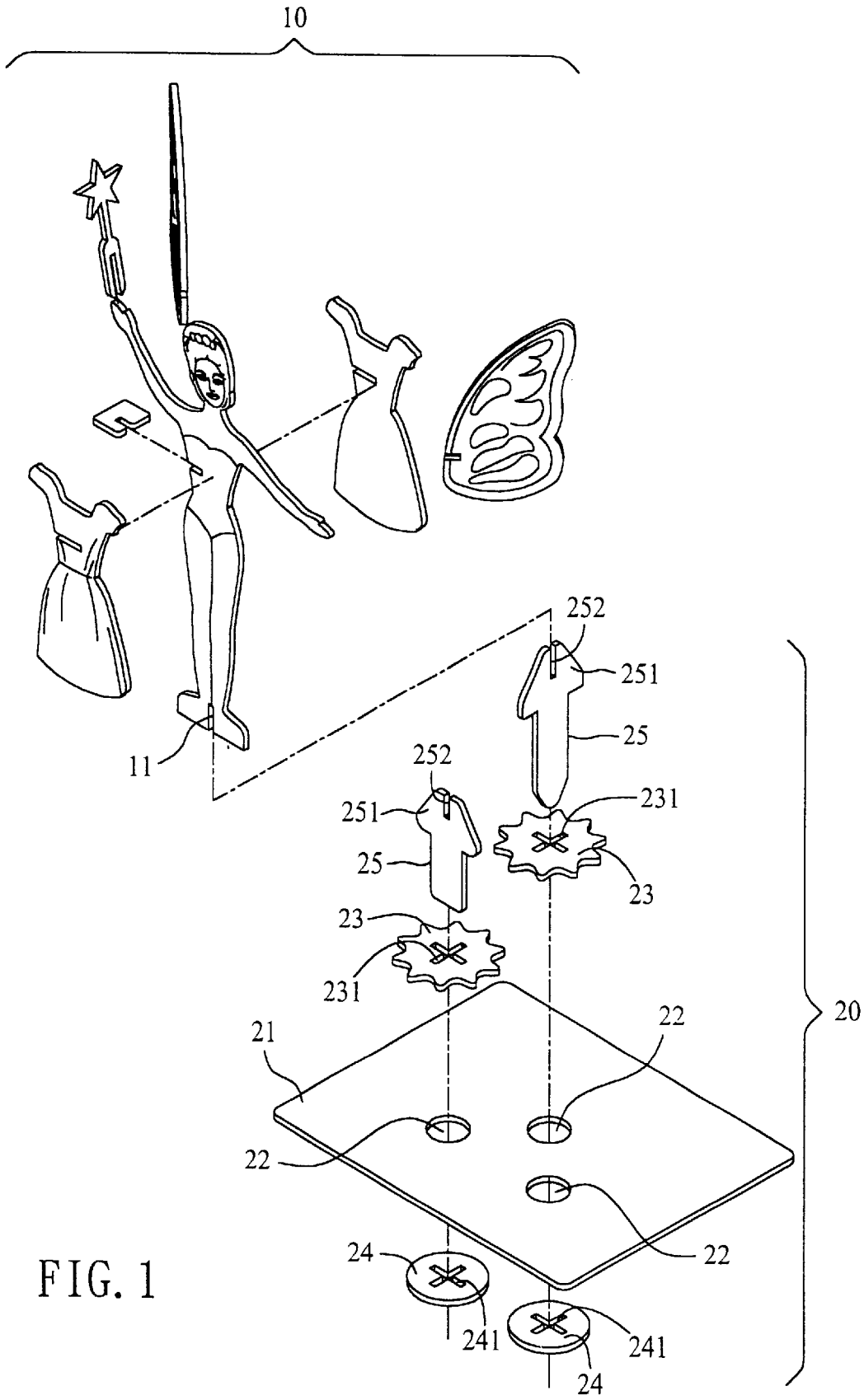
FIG. 1 is an exploded perspective view of a revolving structure for built-up toy according to an embodiment of the present invention.

Please refer to FIG. 1 that is an exploded perspective view of a revolving structure for built-up toy according to an embodiment of the present invention. As shown, the built-up toy, which is generally denoted with reference numeral 10, is formed from a plurality of flat parts connected to one another in a predetermined manner. An engaging slit 11 is always provided at a bottom of each built-up toy 10. More than one built-up toy 10 may be connected to the revolving structure 20 of the present invention. In the illustrated embodiment, however, only one built-up toy 10 is shown. It is understood that the built-up toy 10 may simply be a flat part 10' having a specific shape, so long as the shaped flat part 10' is provided at a bottom with the engaging slit 11.

The revolving structure 20 mainly includes a flat base 21 having a plurality of round holes 22 provided thereon, a plurality of flat gear members 23 in a number corresponding to that of the round holes 22, a plurality of disc-shaped stoppers 24 in a number corresponding to that of the round holes 22, and a plurality of flat rotating shafts 25 also in a number corresponding to that of the round holes 22.

The gear members 23 have an inner diameter larger than an outer diameter of the round holes 22, and are separately located above the round holes 22. The disc-shaped stoppers 24 have a diameter larger than that of the round holes 22 but smaller than the inner diameter of the gear members 23, and are separately located below the round holes 22. The gear members 23 and the disc-shaped stoppers 24 are provided at their centers with fitting openings 231 and 241, respectively.

Each rotating shaft 25 includes a flat long body having a width slightly smaller than the diameter of the round hole 22, and an expanded but upward tapered head that serves as a engaging seat 251 for engaging with the bottom of the built-up toy 10 and has a bottom width larger than the fitting opening 231 on the gear member 23. The flat long bodies of the rotating shafts 25 are adapted to vertically downward extend through the round holes 22 on the base 21 and the fitting openings 231, 241 of the gear members 24 and the disc-shaped stoppers 24, respectively, to abut the bottoms of the engaging seats 251 on upper sides of the gear members 23. This design enables the downward extended rotating shafts 25 to hold the gear members 23 and the disc-shaped stoppers 24 to the upper and the lower side, respectively, of the round holes 22 on the base 21 without the risk of sliding off the base 21. When a rotating shaft 25 is turned, a corresponding gear member 23 is brought to rotate at the same time. The long body of each rotating shaft 25 is downward projected from the base 21 by a predetermined distance to facilitate easy turning of the rotating shaft 25 from a bottom side of the base 21. Each engaging seat 251 is provided at a top center with a downward extended slit 252 for engaging with the engaging slit 11 provided at the bottom of the built-up toy 10, so that the toy 10 could stand upright on the base 21, as shown in FIG. 3.

Figure 2:
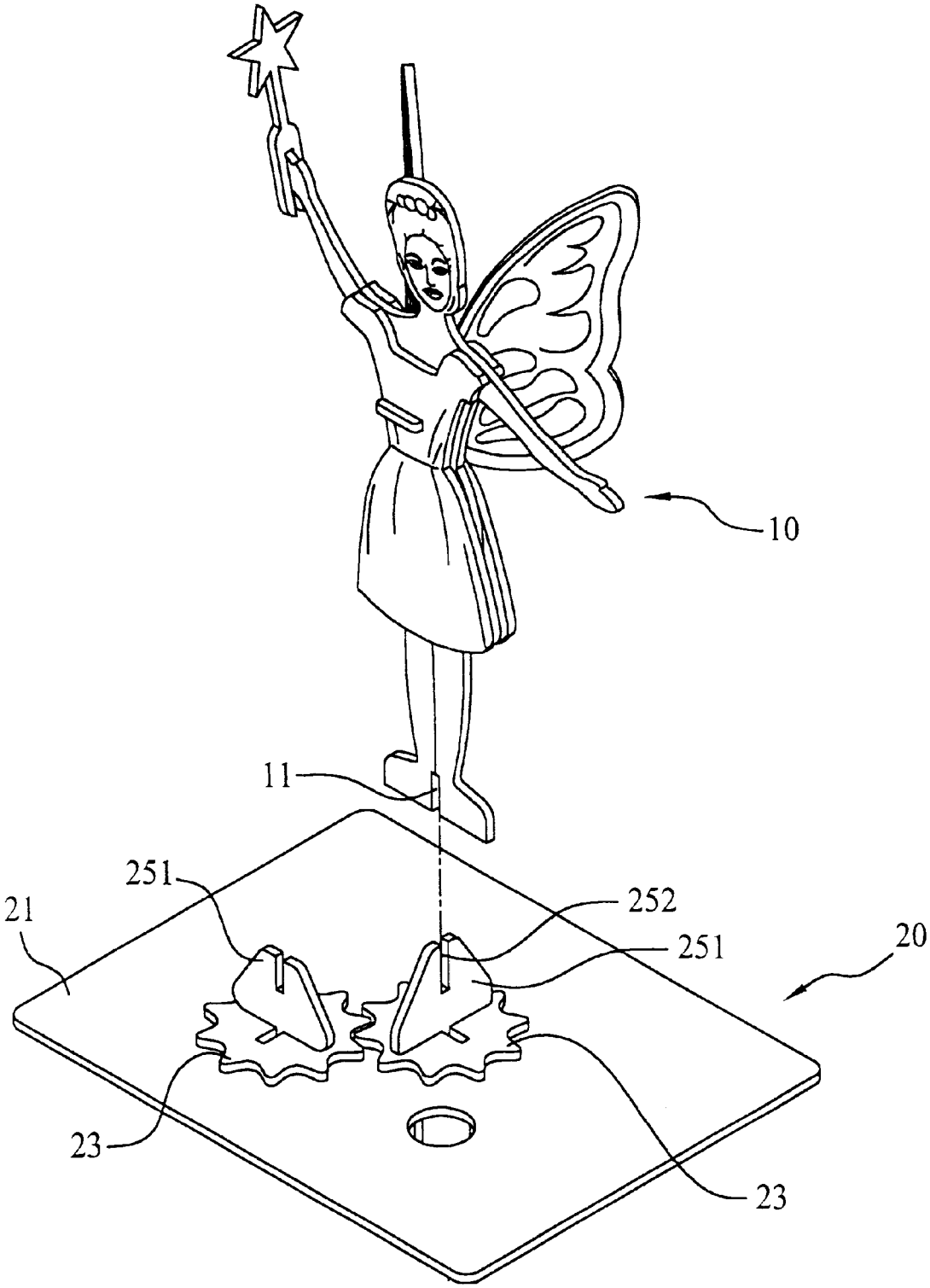
FIG. 2 is a top perspective view of the revolving structure of FIG. 1 in an assembled state and ready for connecting to a built-up toy.

FIG. 2 is a top perspective view of the revolving structure 20 in an assembled state and ready for connecting to the built-up toy 10.

Figure 3:
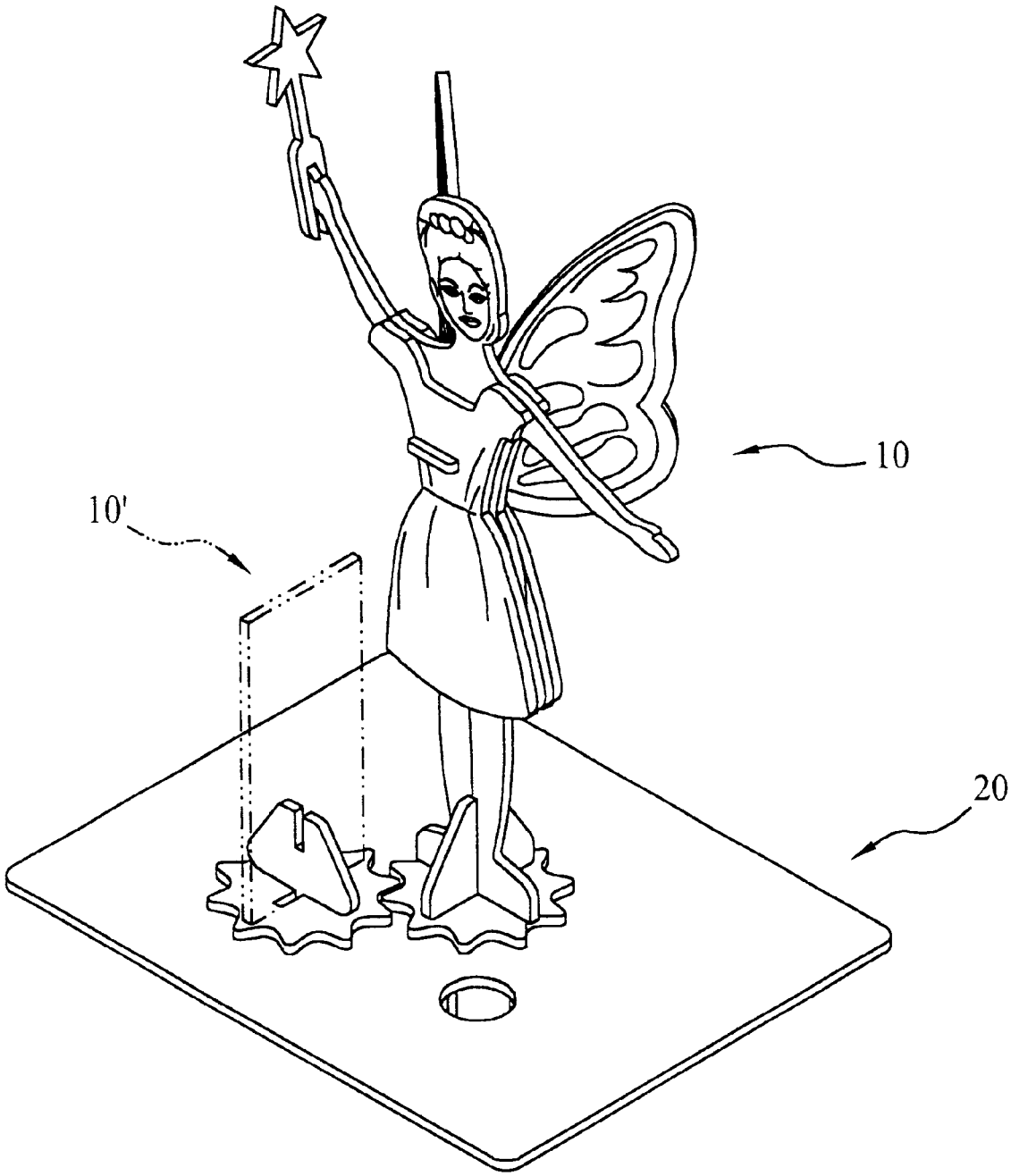
FIG. 3 is an assembled perspective view of FIG. 1.
Figure 4:
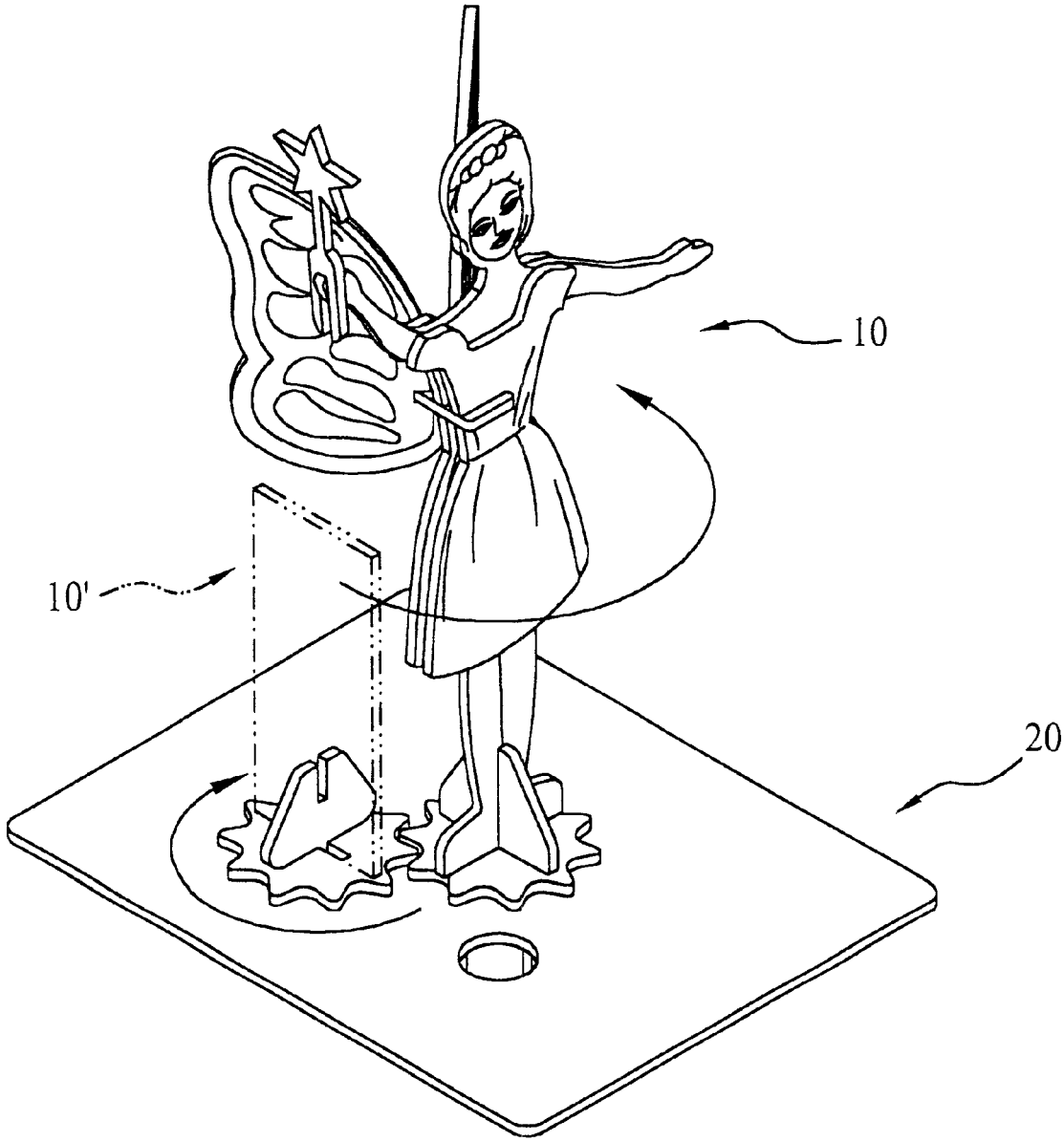
FIG. 4 shows the revolving structure of the present invention is operated to rotate the built-up toy connected thereto.
Figure 5:
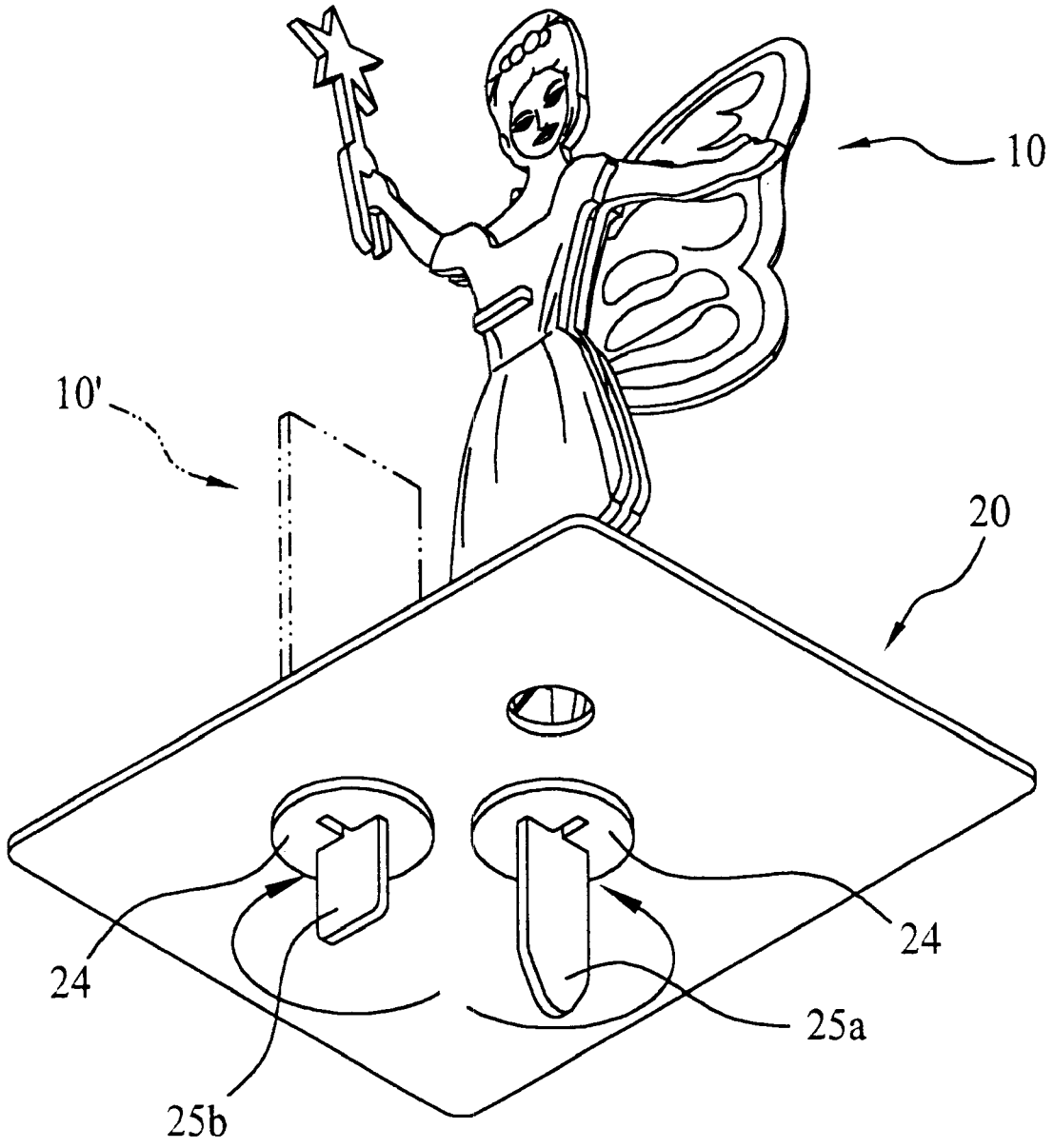
FIG. 5 is a bottom perspective view of the revolving structure of the present invention in an assembled state.

Please refer to FIGS. 3, 4, and 5 at the same time. In a fully assembled revolving structure 20, a lower portion of the long body of each rotating shaft 25 is extended through the disc-shaped stopper 24 to project from the bottom side of the base 21 by a predetermined length. It is to be noted that the gear members 23 located at the top of the base 21 mesh with one another. A player needs to turn from the bottom side of the base 21 only one of the rotating shafts 25 to rotate all the gear members 23, and accordingly, all the built-up toys 10, 10' connected to the engaging seats 251 above the base 21.

With the revolving structure 20, different toys or dolls or figures maybe designed for connecting to the engaging seats 251 of the rotating shafts 25 to show interesting scenes in fairy tales, two fighting opponents, etc., to create an interesting dynamic effect. Of course, the problem of mutually interfered revolving toys or dolls or FIGS. 10, 10' above the base 21 should be considered and avoided.

As can be clearly seen from FIG. 5, one of the rotating shafts 25, as denoted with the reference numeral 25*a*, may be designed to have a downward projected portion longer than that of other rotating shafts 25*b* and serve as a main driving shaft. The longer rotating shaft 25*a* enables a player to turn it without being hindered by other rotating shafts 25*b*.

It is understood that the base 21 could also be provided with only one round hole 22 to connect only one built-up toy 10 thereto via one set of revolving structure 20 consisting of only one rotating shaft and one disc-shaped stopper to create the same interesting dynamic effect. This is a simple change of the present invention providing equivalent functions and should be included in the scope of the present invention as defined by the appended claims.

In brief, the revolving structure 20 of the present invention creates a dynamic effect for the low-priced built-up toys. Moreover, since the revolving structure 20 is also formed from flat parts, it would not affect the basic function of a built-up toy but makes the same more interesting for play.

What is claimed is:

1. A revolving structure for built-up toy, said built-up toy either including a plurality of flat parts connected to one another in a predetermined manner or including only one single flat part having a specific shape, and having a first engaging slit provided at a bottom thereof, comprising:

a flat base having a plurality of round holes provided thereon;

a plurality of flat gear members in a number corresponding to that of said round holes to be separately located above said round holes, said gear members having an inner diameter larger than a diameter of said round holes and being dimensioned to mesh with one another on said base;

a plurality of flat stoppers in a number corresponding to that of said round holes to be separately located below said round holes, said stoppers having an outer diameter larger than the diameter of said round holes; and a plurality of flat rotating shafts also in a number corresponding to that of said round holes; each said rotating shaft having a long body portion, a width of which being smaller than the diameter of said round holes to allow said rotating shaft to vertically downward extend through a respective gear member, round hole, and stopper and project a predetermined length from a bottom side of said base; and a second engaging slit being provided at a top of each said rotating shaft for engaging with said first engaging slit provided at the bottom of each said built-up toy and thereby connecting said built-up toy to the top of said rotating shaft;

whereby when any one of said rotating shafts is turned at said length projected from the bottom side said base, all said built-up toys connected to said rotating shafts are brought to rotate at the same time via said gear members that mesh with one another.

2. The revolving structure for built-up toy as claimed in claim 1, wherein each said rotating shaft has an expanded head portion serving as an engaging seat, said engaging seat having a bottom width larger than that of an opening provided on each said gear member for said rotating shaft to extend therethrough, and said second engaging slit being provided at a top center of said engaging seat.

3. The revolving structure for built-up toy as claimed in claim 2, wherein said engaging seat of each said rotating shaft is upward tapered.

4. The revolving structure for built-up toy as claimed in claim 1, wherein one of said rotating shafts has an increased length to serve as a main driving shaft.

5. The revolving structure for built-up toy as claimed in claim 1, wherein said stoppers are in the form of a disc.

6. The revolving structure for built-up toy as claimed in claim 1, wherein said built-up toys connected to said engaging seats of said rotating shafts are spaced from one anther without interfering with one another when they rotate.

7. A revolving structure for built-up toy, said built-up toy either including a plurality of flat parts connected to one another in a predetermined manner or including only one single flat part having a specific shape, and having a first engaging slit provided at a bottom thereof, comprising:

a flat base having a round hole provided thereon;

a flat gear member being located above said round hole on said base, and having an inner diameter larger than a diameter of said round hole;

a flat stopper being located below said round hole and having an outer diameter larger than the diameter of said round hole; and a flat rotating shaft having a long body portion, a width of which being smaller than the diameter of said round hole to allow said rotating shaft to vertically downward extend through said gear member, said round hole, and said stopper and project a predetermined length from a bottom side of said base; and a second engaging slit being provided at a top of said rotating shaft for engaging with said first engaging slit provided at the bottom of said built-up toy and thereby connecting said built-up toy to the top of said rotating shaft;

whereby when said rotating shaft is turned at said length projected from the bottom side of said base, said built-up toy connected to said rotating shaft is brought to rotate at the same time.

* * * * *